United States Patent [19]

Hoskinson

[11] 4,417,546

[45] Nov. 29, 1983

[54] HEAT RECOVERY SYSTEM FOR AN INCINERATOR

[76] Inventor: Gordon H. Hoskinson, 186 Mayfair Rd., Floral Park, N.Y. 11001

[21] Appl. No.: 302,132

[22] Filed: Sep. 14, 1981

[51] Int. Cl.[3] ..... F22B 33/00

[52] U.S. Cl. ..... 122/20 B; 110/234; 126/365; 237/19

[58] Field of Search ..... 122/20 B; 237/8 R, 19; 126/364, 365; 110/234, 235

[56] References Cited

U.S. PATENT DOCUMENTS

| | | | |
|---|---|---|---|
| 3,896,992 | 7/1975 | Borovina et al. | 237/19 |
| 4,037,786 | 7/1977 | Munroe | 237/19 |
| 4,136,731 | 1/1979 | Deboer | 122/20 B |
| 4,211,187 | 7/1980 | Farris | 122/20 B |
| 4,246,886 | 1/1981 | Sitzlar | 122/20 B |
| 4,258,878 | 3/1981 | Van Pachtenbeke | 237/8 R |

*Primary Examiner*—Edward G. Favors

*Attorney, Agent, or Firm*—Andrus, Sceales, Starke & Sawall

[57] ABSTRACT

A water heating system for use with an incinerator. The incinerator includes a combustion chamber to burn waste material and a stack is connected to the combustion chamber to discharge the hot flue gases. Located within the stack is a heat exchanger. A water heating system is located within a building and includes a closed conduit having a pump to continuously circulate hot water through the conduit. A second conduit connects the first conduit with the heat exchanger in the stack and a second pump is employed to circulate water through the second conduit. In addition, a bypass is connected across the second conduit. A valving system is operable during periods when the incinerator is not operating to flow water through the first conduit and to separately flow water through the second conduit via the by-pass, so that water will continually flow through the heat exchanger. The valving system is operable during periods when the incinerator is operating to flow water from the first conduit through the second conduit to the heat exchanger and return heated water to the first conduit.

9 Claims, 1 Drawing Figure

HEAT RECOVERY SYSTEM FOR AN INCINERATOR

BACKGROUND OF THE INVENTION

Incinerators are commonly used with industrial and commercial establishments to burn waste or trash. U.S. patent application Ser. No. 06081,686, filed Oct. 4, 1979, now U.S. Pat. No. 4,291,633, disclosed an incinerator which can be used in such establishments.

In an attempt to recover the energy resulting from the combustion of the waste material, various types of heat recovery systems have been incorporated with incinerators. In general these heat recovery systems pass the hot flue gases through a heat exchanger to heat water and thereby generate hot water or steam which can be used to supply the entire hot water or steam requirements for the establishment, or to be used in conjunction with a standard hot water or steam supply.

SUMMARY OF THE INVENTION

The invention is directed to an improved heat recovery system for an incinerator. In accordance with the invention, the incinerator, which is mounted outside of the building, includes a combustion chamber where the waste or trash is burned and the hot flue gases are discharged from the combustion chamber through a stack.

Located within the building is a hot water heating system which can include a hot water heater and a hot water storage tank, and a hot water line continuously circulates water through the heating system.

In accordance with the invention, an auxiliary hot water line is connected between the main hot water line in the building and a heat exchanger located within the stack of the incinerator. A valving system is incorporated which is operable, during periods when the incinerator is not operating, to disconnect the main hot water line from the auxiliary line and thereby continuously flow water through the main hot water line and separately flow water through the auxiliary water line via a by-pass. Under this mode of operation, the water is continuously passed through the heat exchanger in the stack even though the incinerator is not operating.

During periods when the incinerator is operating, the valving system permits water to flow from the main hot water line through the auxiliary hot water line to the heat exchanger and the heated water is then returned to the main hot water line.

The heat recovery system of the invention acts to utilize the heat generated by the combustion of the waste material in the incinerator to supply a part of the hot water requirements for the main hot water heating sytem.

With the invention, the auxiliary hot water line is automatically connected into the main hot water line when the incinerator is operating to supply heated water from the heat exchanger to the hot water heating system and when the incinerator is not operating, the water is continuously passed through the auxiliary water line and the heat exchanger to prevent the water from freezing in the auxiliary line and to prevent stagnant water from accumulating in the heat exchanger.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
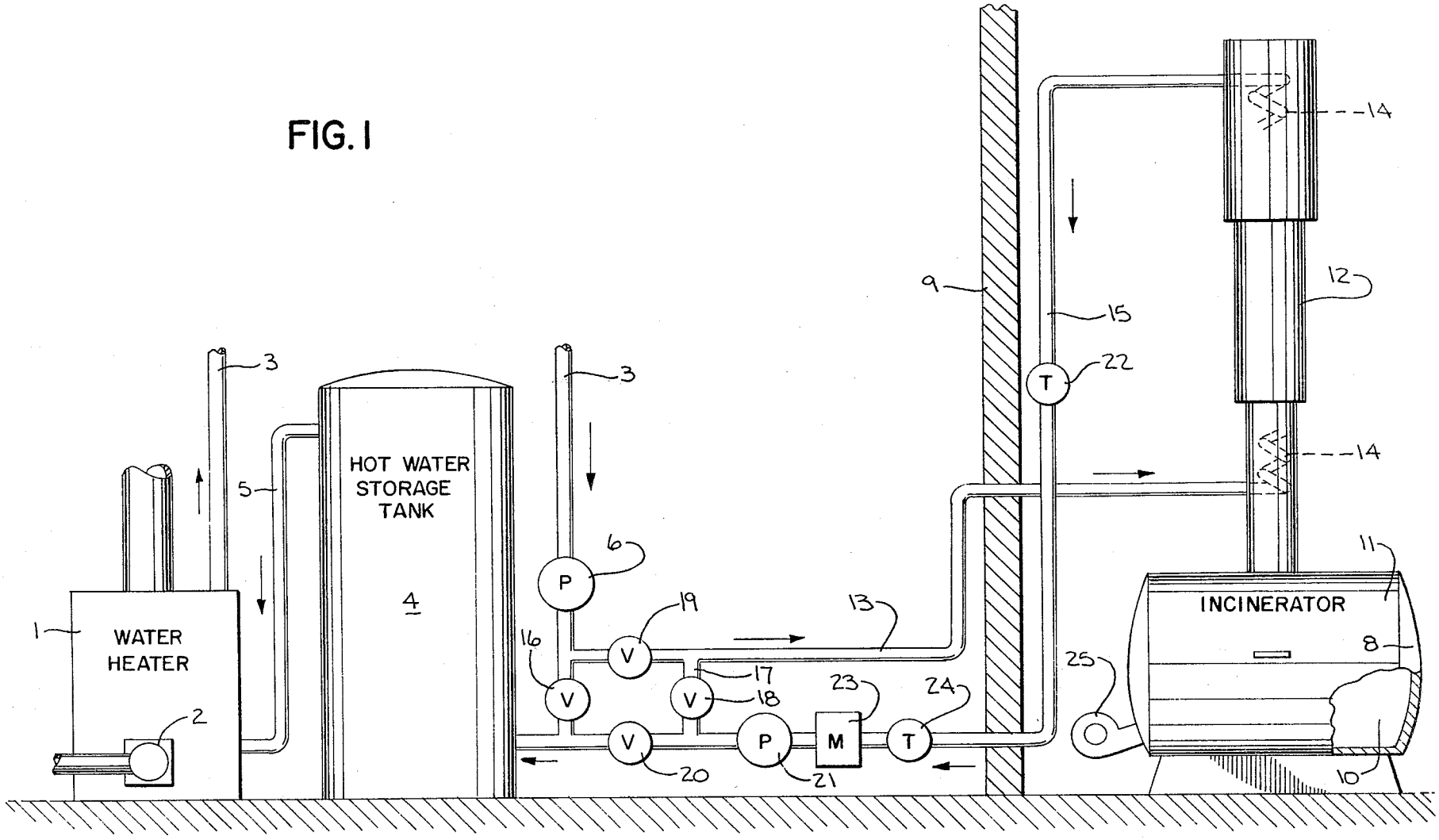
FIG. 1 is a schematic representation of the heat recovery system of the invention.

FIG. 1 shows a heat recovery system for use with an incinerator in which the heat generated through burning of the waste material in an incinerator is utilized to supply a portion of the hot water requirements for a hot water heating system. As shown in FIG. 1, the system includes a standard hot water heater 1 having a gas burner unit 2 which functions to heat water flowing through a coil, not shown, in the heater. The heated water is discharged from the water heater 1 through line 3 and flows to the lower portion of a standard hot water storage tank 4. Water is returned from the storage tank 4 through line 5 to the heater. Heater 1, line 3, storage tank 4, and return line 5, comprise a main hot water line, wherein the water is continuously circulated by a pump 6. Suitable supply lines, not shown, can be connected to the line 3 to conduct heated water to locations of use, as in a conventional system.

While the drawings have illustrated the water heater 1 and water storage tank 4 to be separate units, it is contemplated that in certain installations, the water heating facility may be incorporated with the storage tank.

A conventional incinerator, such as disclosed in U.S. patent application Ser. No. 06081,686, filed Oct. 4, 1979, is located outside of the building 9. The incinerator 8 defines a combustion chamber 10 wherein the waste or trash material is burned. Incinerator 8 is provided with a suitable feed door 11 through which the waste is introduced into the combustion chamber 10.

The waste gases of combustion are discharged from the combustion chamber through a stack 12 and air can be supplied to the stack 12 to burn the combustible waste gases in a secondary zone of combustion in a conventional manner.

In accordance with the invention, a line or conduit 12 connects the line 3 with the lower end of a coil 14 which is mounted within the stack 12 and constitutes a heat exchanger. Water being introduced into the coil 14 through conduit 13 is heated as it flows upwardly through the stack 12 and the heated water is discharged from the coil or heat exchanger 14 through a conduit or line 15 which is connected to the line 3. Lines 13 and 15 pass through suitable openings in the wall 9 of the building. A valve 16 is located in the line 3 and the conduits 13 and 15 are connected to the line 3 on opposite sides of the valve 16.

As shown in FIG. 1, a bypass line or conduit 17 is connected between lines 13 and 15 and a valve 18 is disposed within the line 17. Valves 19 and 20 are located within the lines 13 and 15, respectively, between the main hot water line 3 and the bypass line 17.

The conduits 13, 15 and 17 constitute an auxiliary hot water line and the water is continuously circulated through the auxiliary line by pump 21 which is mounted in line 15.

When the incinerator is not operating, the valve 16 in line 3 is open and valves 19 and 20 in lines 13 and 15, respectively, are closed, so that the pump 6 will flow water through the main hot water line and there will be no supply of water from the main hot water line to the heat exchanger 14 in the stack 12. In this non-incineration mode, the valve 18 in line 17 is open, so that the pump 21 will continuously circulate water through the auxiliary hot water line which comprises the lines 13, 15 and 17. The continuous circulation of water through this line prevents water from freezing in the heat exchanger, or in portions of the lines 13 and 15 located outside of the building, during periods when the incinerator is not operating and prevents the formation of stagnant water in the stack.

The temperature of the water in the auxiliary water line is sensed by an aquastat 22 disposed in line 15. The aquastat 22 is set for a temperature of about 180° F., and when the temperature reaches this seting due to operation of the incinerator, the aquastat is operable to close valve 16 and open valves 19 and 20, so that the pump 6 will then pump water from line 3 through the open valve 19 to the heat exchanger 14, and the heated water will be returned through line 15 to line 3. In this mode of operation, the valve 18 in line 17 is also closed. When the temperature in line 15 falls below the setting of aquastat 22, the system will be returned to its non-incineration mode.

To provide an indication that pump 21 is operating properly a flow meter 23 is mounted within line 15 and provides an indication that water is flowing through the auxiliary hot water line. The meter can be connected to a suitable audible or visual signal so that if the flow within the auxiliary water line ceases, a signal is given to alert the operator.

A second aquastat 24 is mounted in line 15 and is operably connected to a blower 25 associated with the incinerator. The aquastat 24 is set at an elevated temperature, generally above 220° F., and if the temperature rises above this setting, the operation of the blower 25 is discontinued so that the rate of combustion in chamber 10 will be decreased. The operation of the aquastat 24 which is tied into the blower 25 prevents overheating in the combustion chamber.

The heat recovery system of the invention enables the heat generated through the combustion of waste or trash in the incinerator to be utilized to supply at least a portion of the heating requirements for a hot water heating system. When the incineration process is in operation, the auxiliary hot water line is automatically connected into the main hot water heating system to supply heated water to the system. When the incinerator is not operating, the water is continuously flowed through the auxiliary heating line and the heat exchanger to prevent freezing of the water in the heat exchanger and exterior water lines and to prevent the formation of stagnant water in the heat exchanger.

Various modes of carrying out the invention are contemplated as being within the scope of the following claims particularly pointing out and distinctly claiming the subject matter which is regarded as the invention.

I claim:

1. A heat recovery system, comprising an incinerator defining a combustion chamber to burn waste material and having a stack connected to the combustion chamber for discharging hot flue gases, a heat exchanger associated with the stack, hot water heating means including a main hot water line for circulating heated water, first pumping means disposed in said main hot water line for continuously flowing water through said line, an auxiliaty hot water line connected to the heat exchanger, second pumping means to continuously flow water through the auxiliary hot water line, and valve means connected in said main line and said auxiliary line and operable during periods when the incinerator is operating to connect said main line to said auxiliary line whereby water will pass from said main line through said auxiliary line to the heat exchanger and will be returned to said main line, said valve means being operable during periods when the incinerator is not operating to disconnect said main line from said auxilairy line whereby water will circulate separately in each of said lines.

2. The system of claim 1, and including flow measuring means in said auxiliary hot water line to determine the flow of water is said line, said flow measuring means being adapted to actuate a signal when the flow in said auxiliary line falls below a given value.

3. The system of claim 1, and including temperature sensing means in said auxiliary water line and operably connected to said valve means for operating the valve means to connect the auxiliary water line to the main water line when the temperature in the auxiliary water line reaches a predetermined setting.

4. The system of claim 1, and including a building, said incinerator being located outside of said building and said water heater means being located inside said building.

5. The system of claim 3, and including blower means connected to said combustion chamber, and second temperature sensing means in said auxiliary water line and operable at a preset maximum temperature to discontinue operation of said blower means.

6. A heat recovery system, comprising an incinerator defining a combustion chamber to burn waste material and having a stack connected to the combustion chamber for discharging hot flut gases, a heat exchanger associated with the stack, hot water heating means including a main hot water line for circulating heated water, first pumping means disposed in said main hot water line for continuously flowing water through said line, an auxiliary hot water line connected to the heat exchanger, second pumping means to continuously flow water through the auxiliary hot water line, said auxiliary water line including a first conduit connecting the main line to the one end of said heat exchanger and a second conduit connecting the opposite end of said heat exchanger to said main line, the connection of said first conduit to said main line being spaced from the connection of said second conduit to said main line, a bypass conduit connecting the first and second conduit, and a valve system including a first valve being located in the main line between said first and second conduits a second valve disposed in said bypass conduit, a third valve disposed in said first conduit between said main line and said bypass conduit, a fourth valve disposed in said second conduit between said main line and said bypass conduit, said valve system being operable in a non-incineration mode to open said first and second valves and means to close said third and fourth valves when the incinerator is not operating to thereby independently flow water through said main line and said auxiliary line, and said valve system being operable in an incineration mode during periods when the incinerator is operating to close said first and second valves and open said third and fourth valves, to thereby flow water from said main line through said first conduit to the heat exchanger and to return heated water from the heat exchanger through the second conduit to said main line.

7. The system of claim 6, and including first temperature sensing means disposed in said second conduit, said first sensing means being responsive to a predetermined temperature of water in said second conduit to operate said valve system to establish said incineration mode.

8. The system of claim 7, and including second temperature sensing means in said second conduit and responsive to a second predetermined temperature of water in said second conduit for operating said valve system to establish said non-incineration mode, said second predetermined temperature being higher than said first predetermined temperature.

9. A heat recovery system, comprising an incinerator defining a combustion chamber to burn waste material and having a stack connected to the combustion chamber for discharging hot flue gases, a heat exchanger associated with the stack, hot water heating means including a main hot water line for circulating heated water, first pumping means disposed in said main hot water line for continuously flowing water through said line, an auxiliary hot water line connected to the heat exchanger, second pumping means to continuously flow water through the auxiliary hot water line, means responsive to the temperature of the water in said auxiliary line rising above a predetermined setting for connecting said main line to said auxiliary line whereby water will pass from said main line through said auxilairy line to the heat exchanger and will be returned to said main line, and means responsive to the temperature of the water in said auxiliary line falling below said setting for disconnecting said main line from said auxiliary line whereby water will circulate separately in each of said lines.

* * * * *